US007837043B2

(12) United States Patent
Reason-Kerkhoff

(10) Patent No.: US 7,837,043 B2
(45) Date of Patent: Nov. 23, 2010

(54) TEAM DUGOUT ORGANIZER

(76) Inventor: Debra R. Reason-Kerkhoff, 1744 Sparkling Water Cir., Ocoee, FL (US) 34761

( * ) Notice: Subject to any disclaimer, the term of this patent is extended or adjusted under 35 U.S.C. 154(b) by 268 days.

(21) Appl. No.: 12/122,910

(22) Filed: May 19, 2008

(65) Prior Publication Data

US 2009/0283486 A1 Nov. 19, 2009

(51) Int. Cl.
*A47F 7/00* (2006.01)

(52) U.S. Cl. ..... 211/85.7; 211/13.1; 248/308

(58) Field of Classification Search ..... 211/13, 211/85.7, 60.1, 70.1, 113, 118; 248/304, 248/308, 339, 340; 206/315.1
See application file for complete search history.

(56) References Cited

U.S. PATENT DOCUMENTS

| | | | | | |
|---|---|---|---|---|---|
| 283,728 | A | * | 8/1883 | Ward | 211/100 |
| 1,306,297 | A | * | 6/1919 | Auerochs | 211/10 |
| 2,647,642 | A | * | 8/1953 | Kosash | 211/100 |
| 3,592,424 | A | * | 7/1971 | Hargrave | 248/27.8 |
| 4,193,495 | A | | 3/1980 | Keeley | |
| 4,323,162 | A | * | 4/1982 | Steinhilber | 211/100 |
| 4,552,270 | A | * | 11/1985 | Lentz et al. | 211/17 |
| 4,615,503 | A | * | 10/1986 | Garfinkle | 248/224.8 |
| 4,629,065 | A | | 12/1986 | Braaten | |
| 5,020,759 | A | * | 6/1991 | Weber | 248/309.2 |
| 5,294,005 | A | | 3/1994 | Hedges | |
| 5,499,724 | A | * | 3/1996 | Hickman | 211/70.6 |
| 5,758,779 | A | * | 6/1998 | Atkins | 211/32 |
| 5,857,577 | A | * | 1/1999 | Thomas et al. | 211/94.01 |
| 6,749,074 | B1 | | 6/2004 | Hileman | |
| 6,948,627 | B1 | | 9/2005 | Evans | |
| 6,991,204 | B2 | * | 1/2006 | Ay | 248/308 |

* cited by examiner

*Primary Examiner*—Korie Chan
(74) *Attorney, Agent, or Firm*—David G. Maire; Paul Royal; Beusse Wolter Sanks Mora & Maire, P.A.

(57) ABSTRACT

A team dugout organizer for sports such as baseball and softball. The device efficiently organizes player's batting and fielding equipment that must be exchanged in a dugout during the course of a game. A peg bar including a plurality of glove pegs extends across the base plate and is rotatable between use and stowed positions. A helmet strap and hat hook is vertically associated with each glove peg to provide storage for all of the equipment accessed by each player during a field change event. The storage locations may be organized by field position, player name or jersey number, with appropriate indicia being provided. An offset handle and the rotatable peg bar allow the device to be safely and conveniently carried. Adjustable straps and clips provide use flexibility.

18 Claims, 8 Drawing Sheets

TEAM DUGOUT ORGANIZER

FIELD OF THE INVENTION

This invention relates generally to the field of sports equipment, and more specifically to an equipment organizational aid for sports such as baseball and softball.

BACKGROUND OF THE INVENTION

During sports activities such as softball and baseball, teams play varying positions which require equipment specific to that role. For example, when a team is "at bat", the players need batting gloves and protective helmets, whereas when the same team is playing "on the field", the players need catching gloves and hats.

Throughout the game each the team uses their respective dugout to store the required equipment and to prepare for the next inning. Additionally, the teams periodically rearrange fielding positions or insert a new player into the lineup as needed. Once an inning ends, the team must move swiftly and promptly either out of the dugout and onto the field or off the field and into the dugout. Game play cannot resume until the players are in their proper field positions.

Further, ball parks often have multiple games scheduled for sequential use of the playing field and place time limits on each game being played. The teams, spectators and game officials must repeatedly wait until the whole team is properly positioned before the next inning of game play may resume. The next scheduled set of teams waiting to use the playing field must wait until the previous game is completed before they can take the field and begin their own game.

Clearly the efficiency of the teams in shifting to and from their various offensive and defensive positions during innings impacts the game play period and can even have a ripple effect of the time available for the next scheduled games. Younger players are especially prone to delays in changing field position due to their propensity to misplace their respective batting or field equipment when it is not in use.

U.S. Pat. No. 4,193,495 presents an apparatus for supporting, transporting and storing equipment used in playing baseball, in an organized, convenient and readily accessible manner. The apparatus includes a support member upon which is mounted U-shaped clamps for removably holding at least one bat and L-shaped clamps for removably holding at least one batting helmet. The support member can be hung on a fence or backstop or other upright member whereby the equipment is stored in an organized and accessible manner during the game. In addition, the support member is foldable and provided with handles to enhance portability of the apparatus and the equipment mounted thereon.

U.S. Pat. No. 6,749,074 presents a portable rack for arranging and storing baseball bats, balls, batting hats and related baseball equipment. The storage rack is supported on a wall surface with extensible and pivotal deployable equipment engaging extensions for receiving baseball equipment. Clip assemblies allow for selective attachment and removal from a wall-supporting surface.

U.S. Pat. No. 4,629,065 provides a baseball equipment holder comprising an elongate tubular housing that can have a diameter sufficient to accommodate a plurality of playing balls in side-by-side relationship. A plurality of longitudinally aligned openings open to the housing to retain a plurality of baseball bats. Hanger members extend from the housing for suspending items of baseball equipment. The housing is connectable to upright structure such as a chain link fence.

U.S. Pat. No. 5,294,005 provides a portable modular sports equipment rack includes elongated telescoping tubular mounting members for accommodating a number of different types of hooks specifically adapted to receive different types of softball or baseball equipment, including at least fielding gloves, batting helmets and bats. Tubular spacer elements maintain a desired space between different pieces of equipment. A plurality of aligned apertures in a line along the tubular mounting members allow the length of the rack to be adjusted easily and is locked into the desired length by a snap button fastener engaged in two aligned apertures in the telescoping members. Aligned apertures through both side walls of the tubular members along a diameter of a cross section of the tubes adjacent to their ends allow the rack to be conveniently suspended from a chain link fence by a clevis pin through the apertures. The rack allows equipment to be stored at games, during travel to and from games, and at a remote storage cite, such as a locker room, if desired.

Despite the foregoing references, the need to improve game playing efficiency remains.

DETAILED DESCRIPTION OF THE INVENTION

Figure 1:
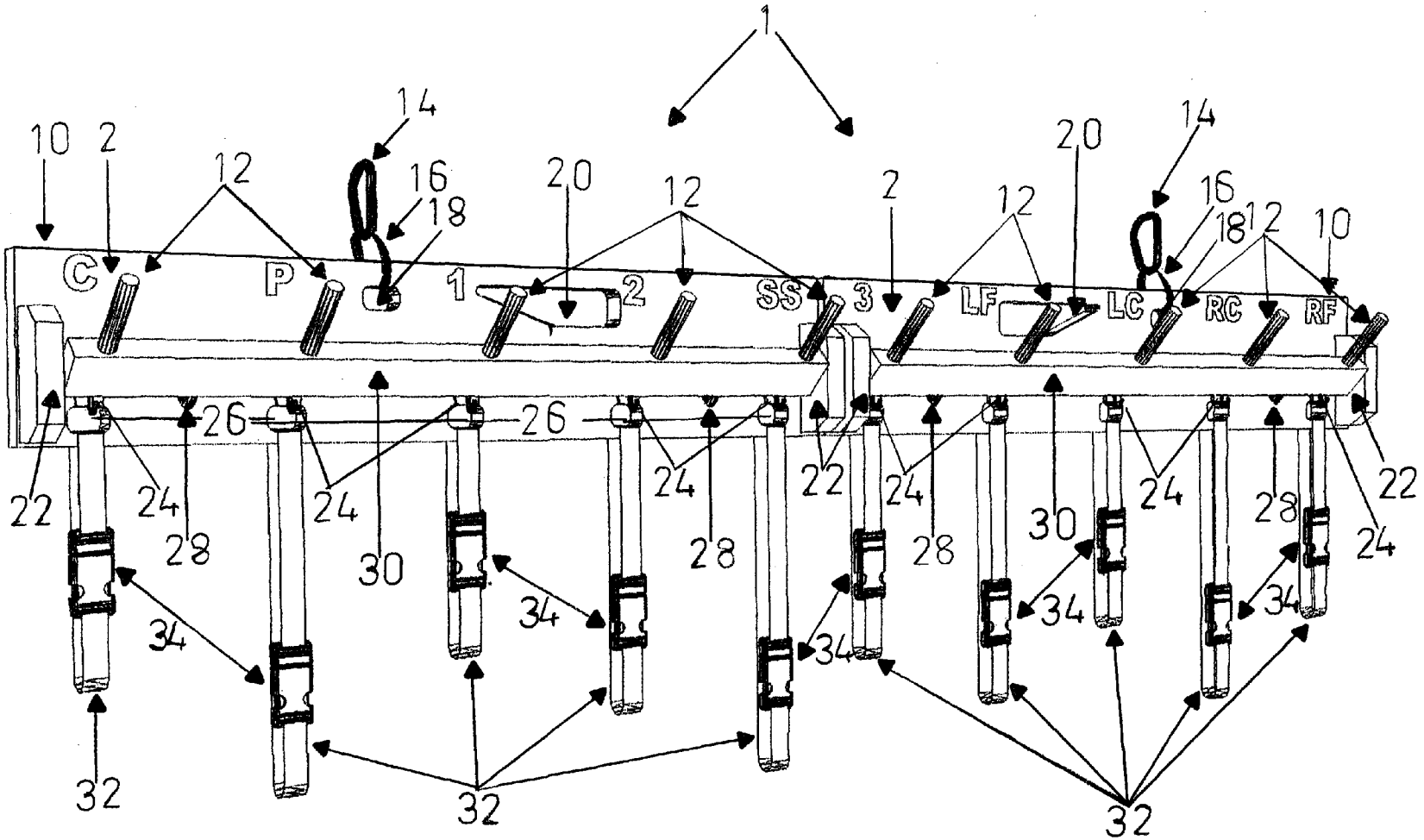
FIG. 1 shows the front view of the Team Dugout Organizer during use.

The present inventor recognizes that an organized dugout would enable the players and coaches to maintain better control of the equipment needed during the playing of the game, which in turn would enhance the efficiency of the game by saving time. However, the present inventor has further recognized that the prior art devices described above fail to prevent the chaos that often occurs in a dugout area when nine or ten young players are simultaneously rushing to find their respective batting or fielding equipment during a field change. Furthermore, while there is a need to transport and to use dugout organizing equipment at multiple fields, the prior art devices are often difficult to transport and are not adequately flexible for set-up at multiple locations. The present inventor has also realized that prior art devices are easily upset and are prone to having equipment fall from the device.

The various embodiments of the present invention innovatively address various limitations of the prior art devices. The disclosed equipment storage device may be carried in a folded configuration, with swivel mechanisms drawing protruding pegs inward when it is being carried, thereby providing a more compact and safe configuration for transport. A handle used to hold the device may be located away from a center of gravity of the device to automatically cause the device to assume a vertically angled orientation when being held by the off-center handle. Adjustable support devices may be provided to allow the device to be maintained level even when it is supported from an uneven base. Player specific equipment storage locations are provided to expedite the game by allowing all position players to easily locate all of the equipment they will need to access during a field change event, specifically the fielding glove, hat, helmet, and batting glove. The storage designations for the various pieces of equipment may be organized by field position so that multiple players may approach the device, side by side, to exchange all of the equipment each needs for a field change without interfering with each other. Furthermore, the storage designations may be organized by field position so that a player may access equipment for his/her "glove buddy" (player on the field in the position next to them) without moving relative to the device. By minimizing the physical movements necessary to accomplish a field change event, these innovative features allow a field change event to be accomplished more efficiently in the limited dugout space, especially for young players who otherwise would not have the self-discipline to keep all of the field-change equipment conveniently stored together in a single location.

As shown in FIGS. 1-8, one embodiment of the present invention, called a Team Dugout Organizer (1) is comprised of two base plates (10) foldably attached together such as with a hinge system (38). Each base plate (10) includes a front face (2), a rear face (3), a top section having a handle formed by a handle opening (20), and a clip strap (16) extending through at least one clip strap opening (18) positioned within the top section. Each base plate (10) further includes a bottom section having a plurality of helmet strap openings (26) with adjustable helmet straps (32) extending through the helmet strap openings (26). Each helmet strap (32) includes a helmet strap clip (34). The adjustable helmet strap (32) provides the ability to mount helmets which vary in size and shape. Additionally, the ability to shorten or lengthen the helmet straps (32) allows the user to position helmets in a vertically staggered alignment, thereby increasing the space between adjacent stored the helmets. Further, the adjustability of the helmet straps (32) allows users of varying heights to make use of the Team Dugout Organizer 1.

The base plate handle opening (20) is positioned such that when the rear face (3) of both of the Team Dugout Organizer base plates are brought together, the base plate handle openings (20) are in alignment with each other thereby permitting a user to hold both base plates simultaneously. Further, the base plate handle openings (20) can be aligned off-set from a center of gravity or midpoint of the base plate front face (2) such as where the base plate handle openings (20) are positioned somewhat closer to the base plate hinge system (38) than the opposed ends of the device. This allows the device to automatically tilt vertically when being carried by the handle, thus providing a shorter and safer orientation during transportation. When the device is folded to the transport configuration, the fence clips (14) may be joined together to secure the device in the closed position.

Mounted at opposite ends of each base plate front face (2) are brackets (22) that support a pivotally attached peg bar (30) which extends transversely across each base plate front face (2) thereby interconnecting the brackets (22). Each peg bar (30) includes a plurality of glove pegs (12) which generally extend in the direction of the base plate (10) top section. Each peg bar (30) further includes at least one angle stop (28) which generally extends in the direction of the base plate (10) bottom section. The glove pegs (12) may be spaced approximately 6 inches apart or at least adequately enough to allow fielding gloves to be positioned at each of the glove pegs (12). The glove pegs (12) are used to hold field gloves by directing the peg through the wrist strap opening and/or finger hole of the glove.

Figure 7:
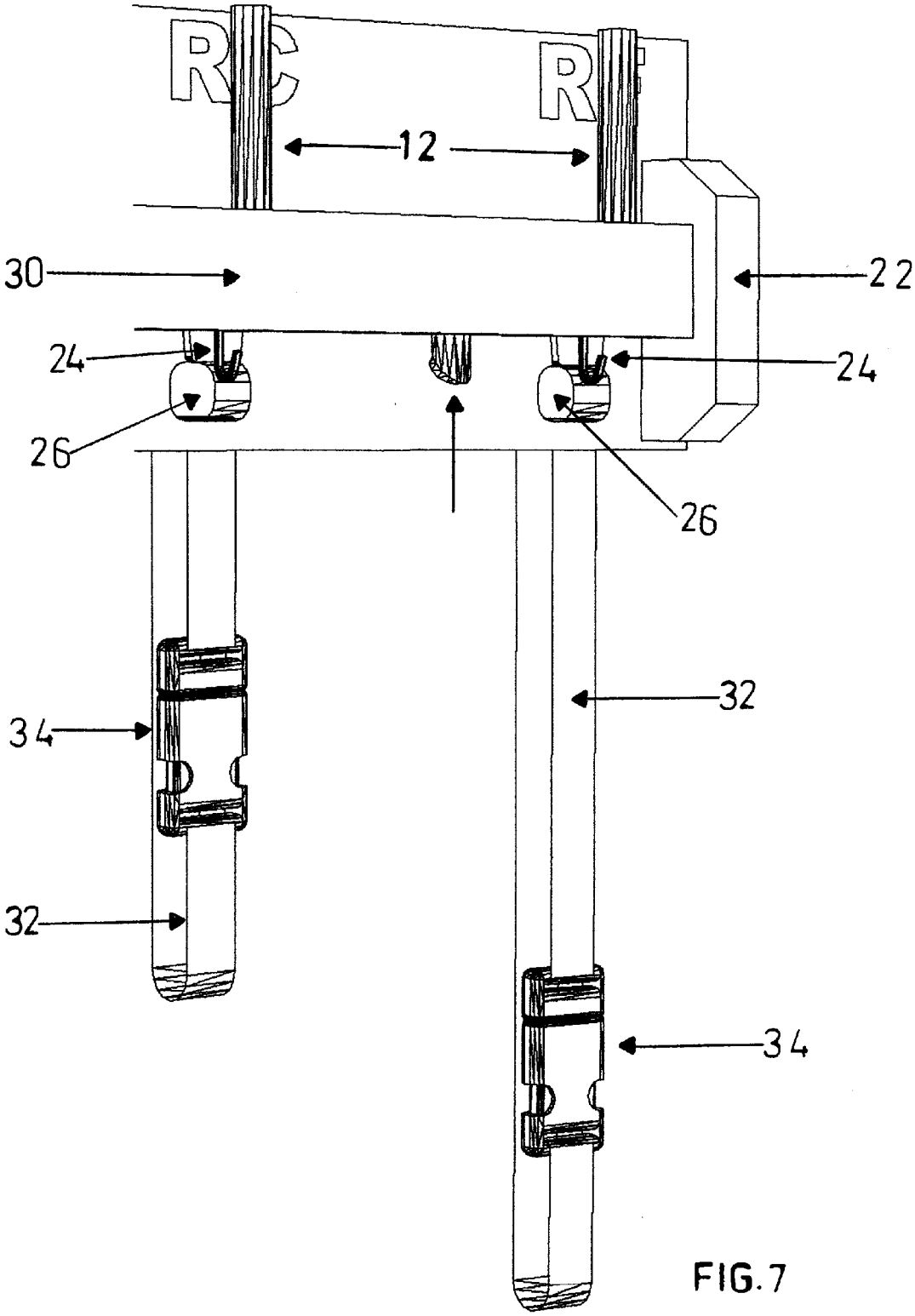
FIG. 7. shows the peg bar of the Team Dugout Organizer in the closed position.

Each peg bar (30) is pivotable, at the brackets (22), between a stowed position, as shown in FIG. 7, where the glove pegs (12) are closest to the base plate (10) top section, to a use position where the glove pegs (12) are furthest from the base plate (10) top section, as shown in FIG. 1. The range of pivotal rotation of the peg bar (30) is determined by angle stop (28) which abuts the base plate (10) at the limit of the pivotal rotation of the peg bar (30). In the stowed position the pegs are drawn toward and preferably contact the base plate, thereby minimizing the width of the device in its folded configuration and reducing the chance that the pegs will hit something when the device is being carried. The peg bar (30) can be pivotally spring biased to aid in its rotation or can include pivot indents or detents to rotate the peg bar (30) at predetermined intervals. The glove pegs (12) may have a variety of configurations, such as cylindrical or star patterns, curved shaping, a pyramidal, square, or rectangular shape, enlarged tips, bi-furcated bodies, bores through the body, embossing, or depressions. Further the glove pegs (12) may be composed of various surface material including tacky material, slip resistant material, metal surfacing, and coated or painted surfacing.

Mounted on each base plate front face (2) are hat hooks (24) which are positioned below the peg bar (30) and generally vertically aligned with the glove pegs (12).

FIG. 1 shows an exemplary front view of the Team Dugout Organizer configured for use wherein field position marking or indicia is associated with each glove peg (12) and used to designate the various field positions where C=catcher, P=pitcher, 1=first base, 2=second base, and SS=short stop, etc. The arrangement of the field position marking or indicia may directly correspond with the sequence and orientation of the positions on the playing field so that players can efficiently remove or place their specific playing equipment on the Team Dugout Organizer in an orderly manner as they enter and exit the dugout. If a player is already on the field when the team is leaving the dugout (for example having been left on base at the end of the half-inning), the player in the dugout whose equipment is nearest the fielded player's equipment can easily recognize that specific equipment needs to be taken out to the fielded player. This will prompt him/her to take that equipment to his "glove buddy" as he/she leaves the dugout. This increases game efficiency by eliminating the delay caused by the fielded player returning back from the field to the dugout to locate his/her equipment.

Additionally, where ball teams are organized so that players who are "glove buddy's" place their equipment, such as a glove, on the Team Dugout Organizer at a location which is designated for that specific field position, it allows players to quickly locate the appropriate glove and equipment rather than have to sort through a pile of items or track down their "glove buddy" to get the glove or equipment from him/her. Additionally, the indicia used to designate the players can be customized for the user or the joint "glove buddy" users. Essentially, by using the Team Dugout Organizer and it's glove pegs (12) and associated storage structures, players can quickly locate the proper glove and other equipment, thereby avoiding the confusion and time delay caused by trying to match the various equipment to each player at the beginning and end of each inning. Further, since ball games traditionally last nine or more innings and involve two teams exiting and/or entering the field at the beginning or end of each inning, the increase in the orderly nature of the team transitions between innings and after the game made possible through the use of the Team Dugout Organizer generates a noticeable time savings over the duration of a game or multiple sequentially played games.

FIG. 1 presents the peg bars (30) in a downward, use position, where the rotation of the peg bars (30) has been limited by the angle stops (28). The glove pegs (12) in the use position are in a position to hold gloves mounted onto the glove pegs (12). As shown in FIG. 1 the Team Dugout Organizer is readily mounted to a support (not shown) such as a fence, posts, or a wall via a fence clip (14) attached to the adjustable-length clip strap (16) which extends through the clip strap opening (18) positioned within the top section of the base plate (10). The fence clip (14) may also serve to secure the base plates (10) together when the Team Dugout Organizer is in a stowed or transport configuration.

Figure 2:
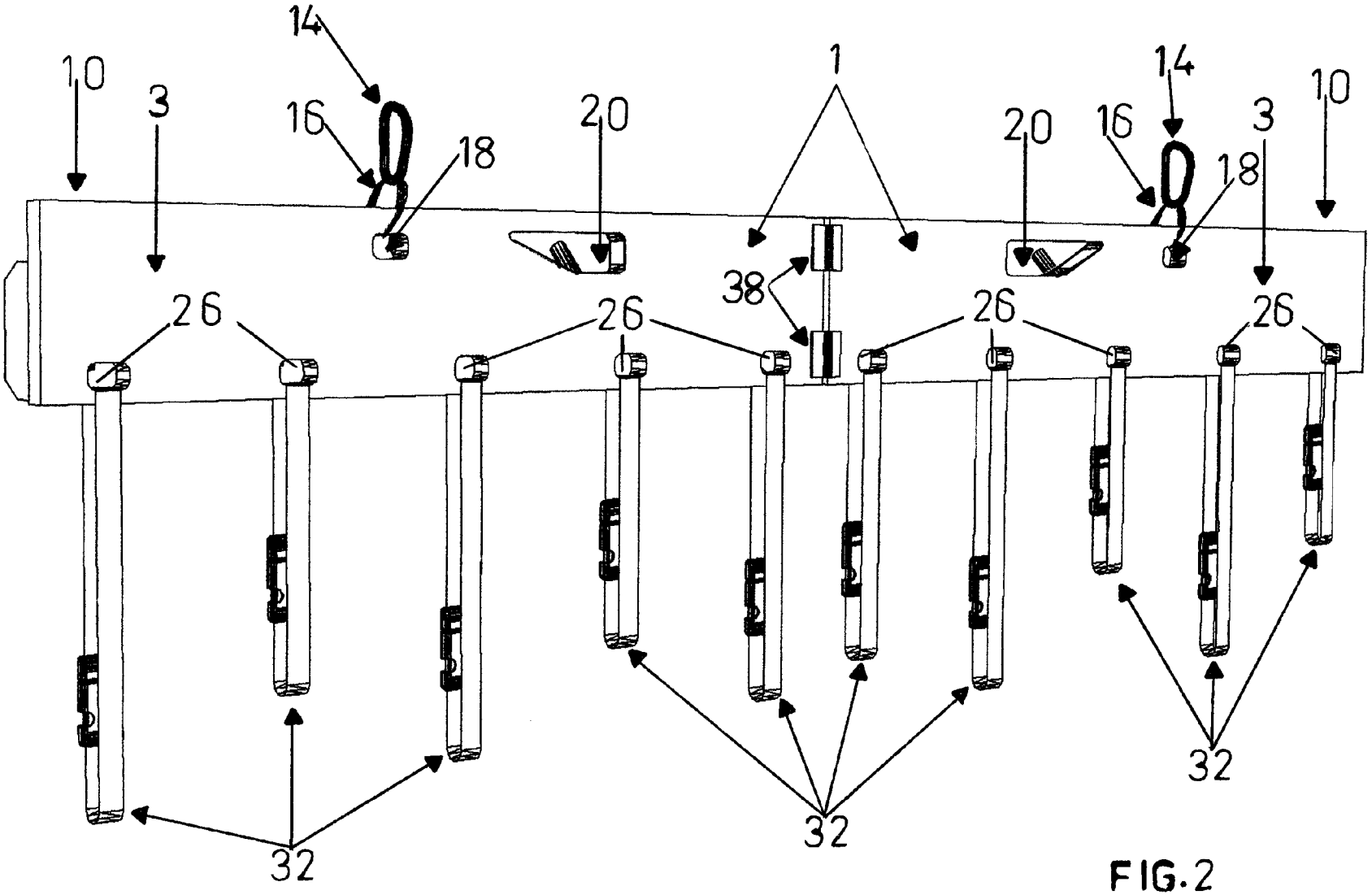
FIG. 2. shows the rear view of the Team Dugout Organizer positioned.
Figure 8:
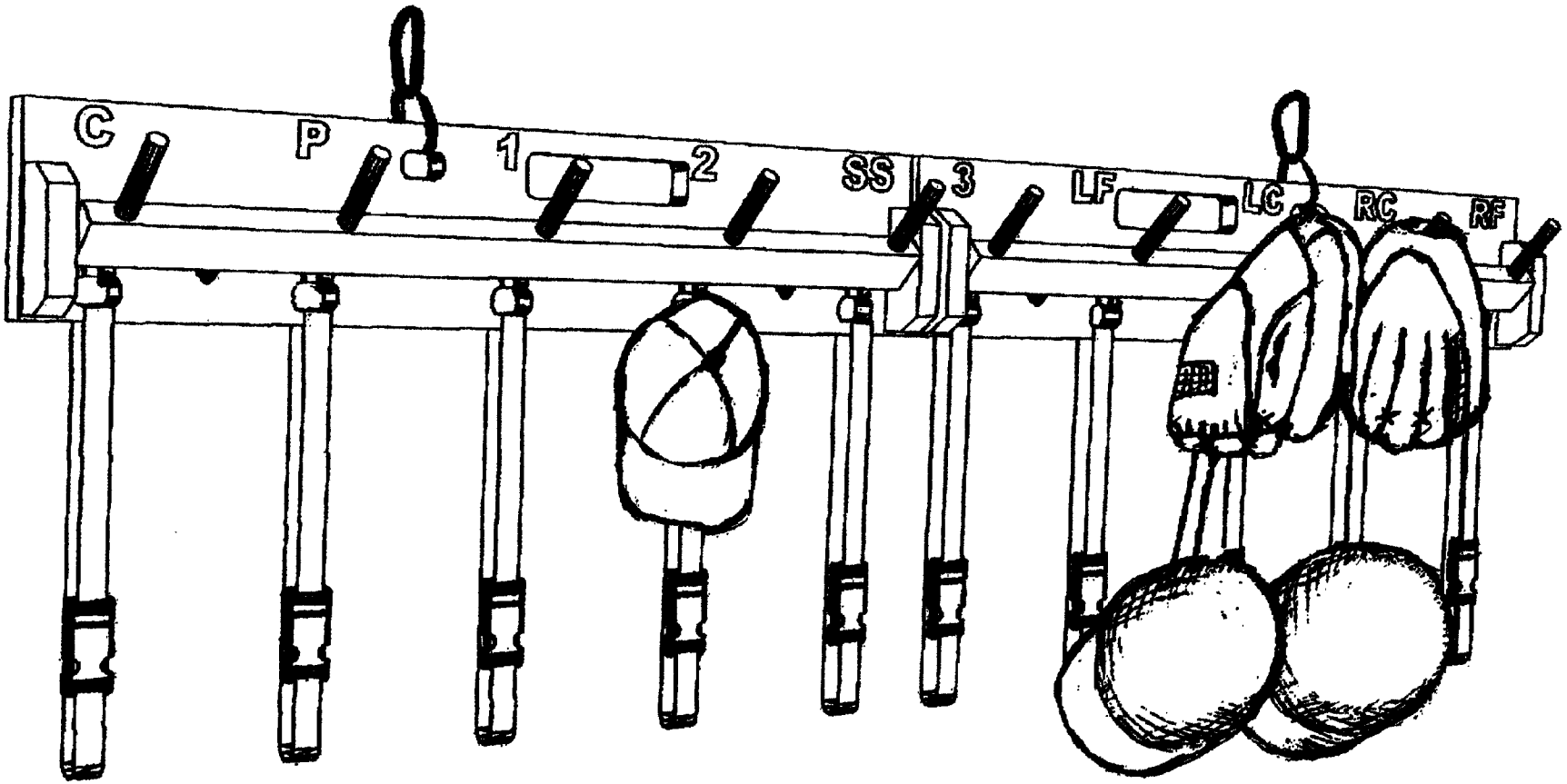
FIG. 8 shows the Team Dugout Organizer with exemplary equipment attached.

FIG. 2 shows the rear view of the Team Dugout Organizer in the use position as it would hang on a support. The rear view provides a view of the hinge system (38) in the use position (unfolded position) where the hinge system (38), as shown, rotatably attaches the two base plates (10) together. While in the use position, fielding gloves are mounted on the glove pegs (12) while helmets and batting gloves are attached via the helmet straps (32), and hats are hung on the hat hooks as shown in FIG. 8.

Figure 3:
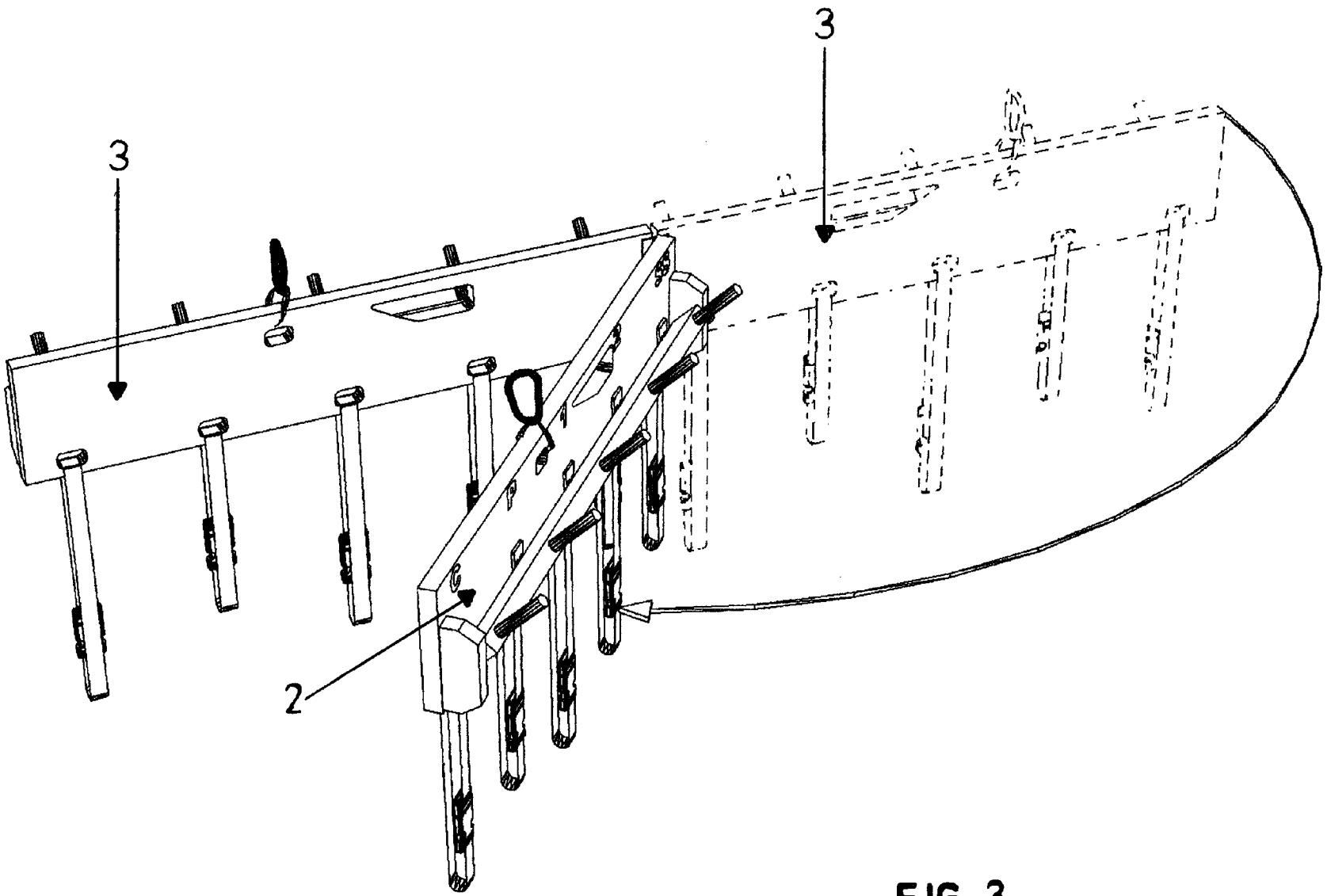
FIG. 3. shows the Team Dugout Organizer being folded for transport.

FIG. 3 shows how the Team Dugout Organizer base plates (10) can fold together into a stowed or transport configuration. To fold the Team Dugout Organizer into the stowed or transport configuration, bring both base plate (10) rear faces together while pivoting (folding) them at the hinge system (38). The hinge system (38) may include, but is not limited to, interlocking elements, at least one elastic band, separable elements, non-separable elements, permanently attached elements, and non-permanently attached elements. In general usage, the Team Dugout Organizer should be folded after it has been removed from the fence, posts, wall, or support.

Figure 4:
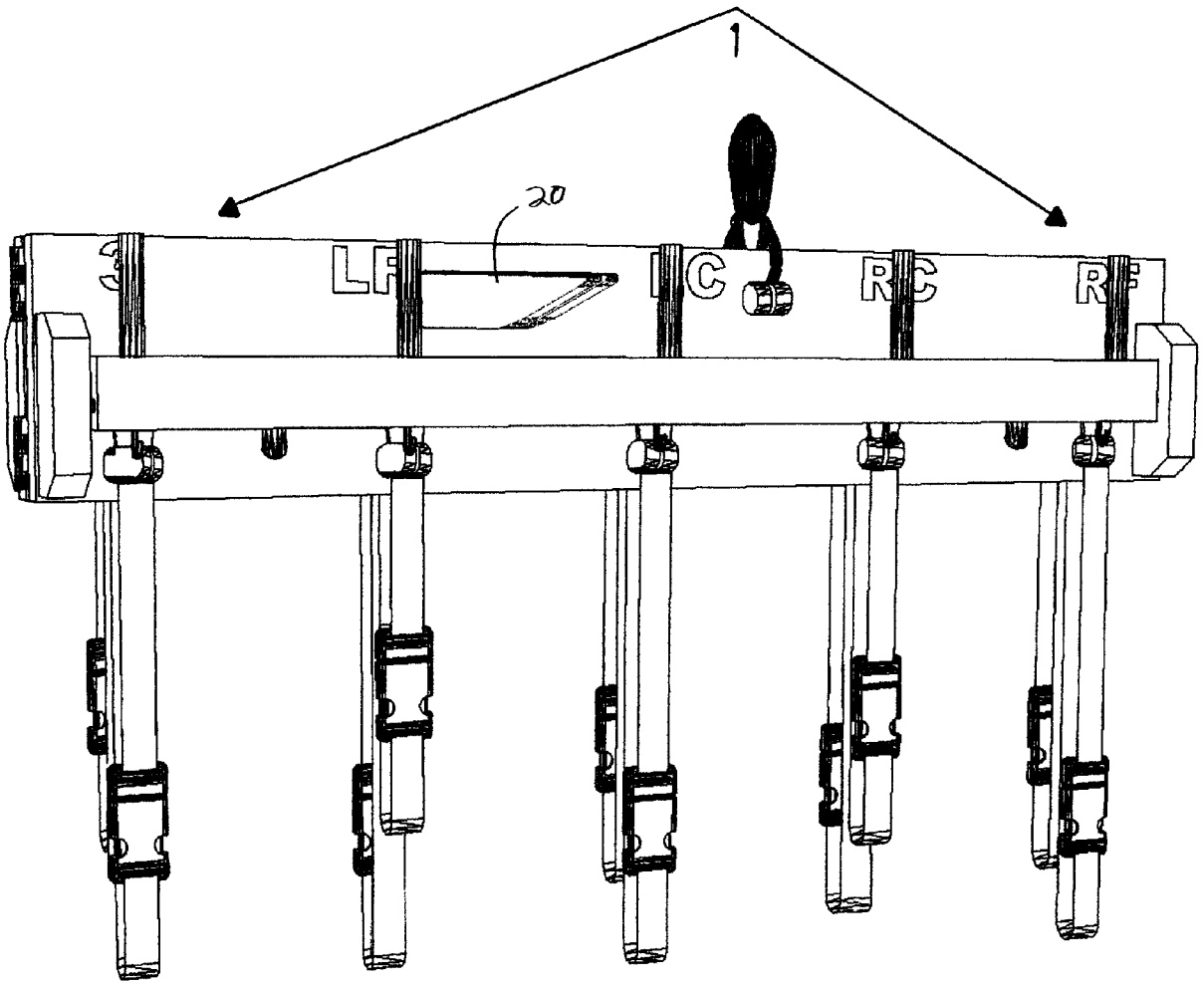
FIG. 4. shows the Team Dugout Organizer in a storage position.

FIG. 4 shows the Team Dugout Organizer in the folded stowed or transport configuration. In this position the user is able to grasp the off-set handles (20) to carry the Team Dugout Organizer. The off-set handles (20) are designed to enable the carrier to hold the Team Dugout Organizer in a balanced condition with the base plates angled to the horizontal position such that the end furthest away from the off-set handles (20) is lowest. Further, the off-set handles may be shaped and positioned such that a top surface of the opening that is supported by the user's hand may be substantially parallel to the ground when the Team Dugout Organizer is being carried. The off-set handle/handle opening (20) positioning provides a safety feature so that during transport, the user will not inadvertently hit people with the Team Dugout Organizer. Additionally, when the base plates (10) are together the user holds both the off-set handles (20) keeping the Team Dugout Organizer in the stowed or transport configuration.

Figure 5:
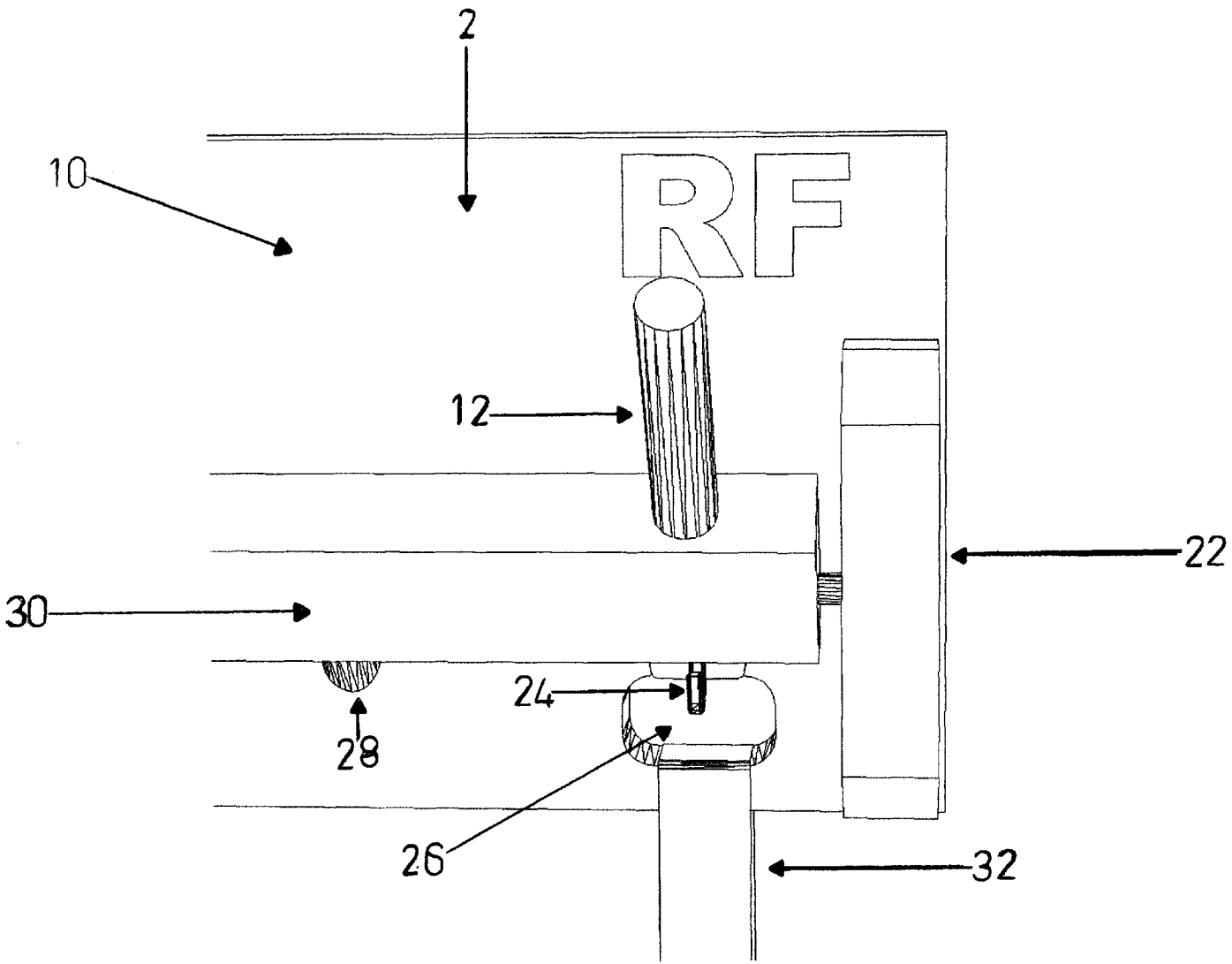
FIG. 5. shows a close up of the Team Dugout Organizer peg bar.

FIG. 5 shows an exemplary view of the field position marking, base plate (10), glove peg (12), peg bar (30), angle stop (28), bracket (22), hat hook (24), helmet strap opening (26), and the helmet strap (32). As presented, the glove peg (12) is in a downward (use) position ready to support a player's glove. Further, FIG. 5 shows the peg bar (30) pivotally attached about an axis of rotation to the bracket (22), which enables the peg bar (30) to move forward (away from the base plate 10 front face) and back (towards the base plate 10 front face) in an easy to operate manner.

Figure 6:
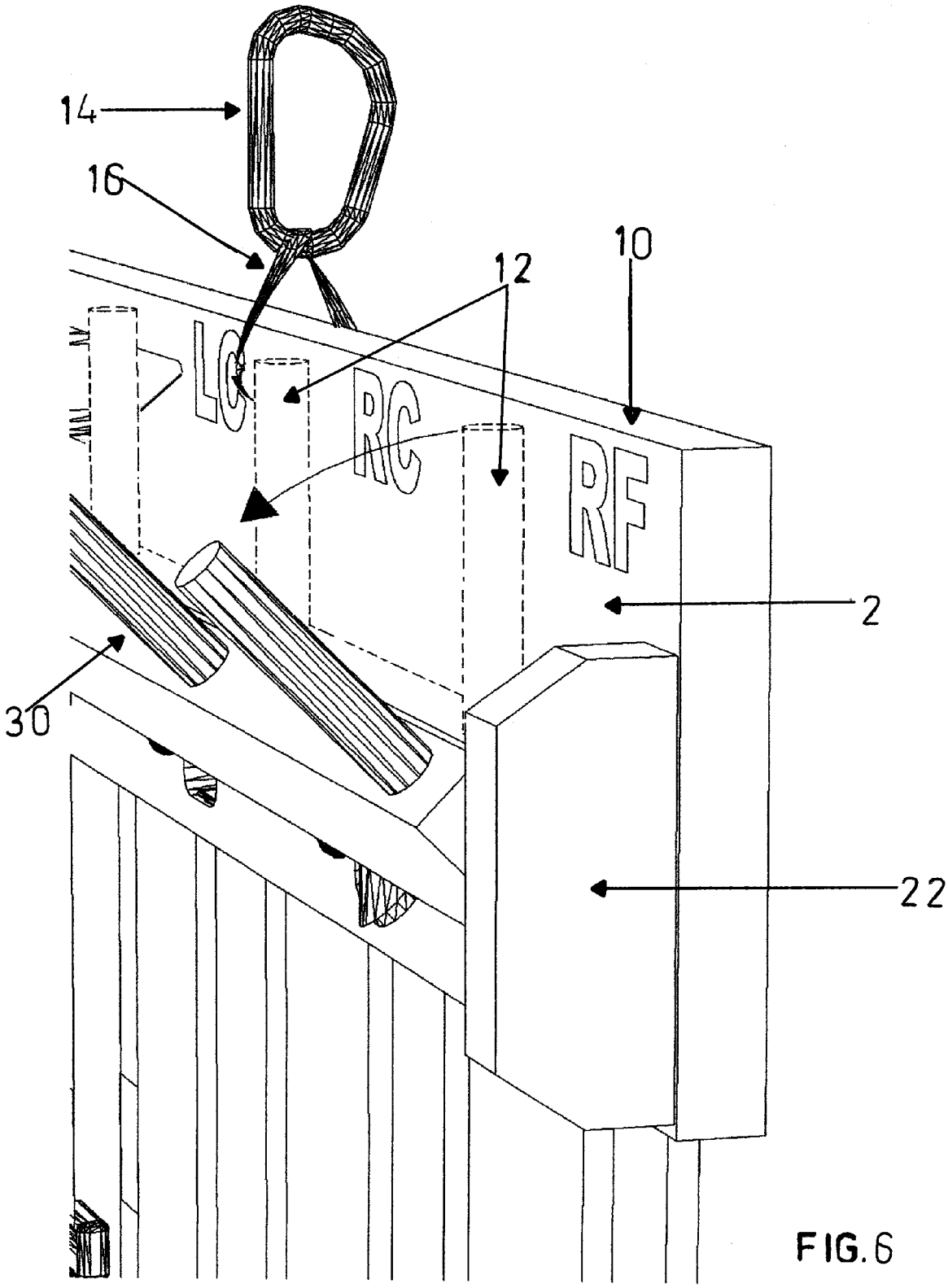
FIG. 6. shows the rotation of the peg bar of the Team Dugout Organizer.

FIG. 6 shows an up close view of the motion of the glove peg (12) when moving from a use position (solid lines) to a stowed, transport, or closed position (dashed lines). The stowed position of the glove pegs (12) is when the glove pegs (12) are up against or proximate the base plate front face (2) and top section. The glove pegs (12) preferably do not extend past the top of the base plate (10) when in the closed position. This enables safe transportation of the Team Dugout Organizer with out any of the glove pegs (12) protruding upward to break off or catch on something. In the use position the pegs are held at a somewhat upward angle, i.e. less than ninety degrees relative to the plane of the base plate to allow the gloves to be retained on the pegs by gravity. Various embodiments may utilize an angle of 45 degrees or anywhere in the range of 40-60 degrees or less than 70 degrees. An angle of about 45 degrees has been found to correspond to the shape of most fielding gloves such that the gloves will rest most securely against the device while being supported by the peg. The fact that the pegs are disposed at less than a 90 degree angle relative to the base plate provides a secure holding position for the gloves. Even if the device is bumped, such as someone running into the fence upon which the device is supported, the gloves stored thereon will not fall off of the pegs due to the influence of gravity and the angled orientation of the pegs.

FIG. 7 shows another view of the glove peg (12) in the stowed position against the base plate (10). As shown, when in the stowed position neither the glove pegs (12) nor the hat hooks (24) extend past the peg bar (30) in the plane perpendicular to the base plate front face (2) in order to minimize the change of them catching on something when the device is being carried.

In an exemplary use of Team Dugout Organizer, the user/ball player simply opens it up to the use position, grasps a fence clip (14) and connects it to the fence or support. The user will next attach the other fence clip (14) and the Team Dugout Organizer is now fully extended against the fence or support. If the user should need to adjust one strap or the other to make the device level, the user can simply adjust the clip strap (16). Once the device (10) is hanging level on the fence or support, the peg bar is rotated to its use position and the device is ready for use. The players upon exiting the field, can locate their position on the device (10), and put their individual field glove on the appropriate glove peg (12), their hat on the appropriate hat hook (24), their batting helmet, and batting gloves on the appropriate helmet strap (32). The batting glove is held on the strap by opening the wrist strap on the glove and re-closing it around the helmet strap (32). The helmet strap clip is opened and the strap is inserted through one of the helmet ear openings, and the clip is then reconnected to secure the helmet to the device. With this arrangement, even if the device is bumped, the helmet will remain securely attached to the device. Conversely, as players prepare to go onto the playing field, they can quickly locate their appropriate equipment, thereby increasing the game playing efficiency.

If transportation is not a significant concern in any application, an embodiment of the Team Dugout Organizer may be provided with a single base plate (10) without hinges but with the same features of the embodiment presented above.

This Team Dugout Organizer maybe manufactured of known materials, including but not limited to: cloth, metal, aluminum, wood, plastic, Velcro™, and or composite materials.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. A portable Team Dugout Organizer for organizing individual player's equipment, comprising:

two base plates foldably attached together, each base plate comprising a front face, a rear face, a bottom section, and a top section comprising a handle opening;

a peg bar pivotally attached to each respective base plate front face, each peg bar comprising a plurality of pegs which extend in a direction generally upwardly toward the respective base plate top section; and an angle stop disposed to limit rotation of each respective peg bar so that a maximum angle of rotation of the respective pegs away from a plane of the respective base plate is less than ninety degrees;

wherein each angle stop is attached to the respective peg bar.

2. The Team Dugout Organizer of claim 1, wherein position marking or indicia is associated with each peg to designate an order corresponding with a sequence of positions on a playing field to facilitate players efficiently placing or removing their respective playing equipment on the Team Dugout Organizer in an orderly manner as they enter or exit a dugout.

3. The Team Dugout Organizer of claim 1, wherein brackets on each base plate front face pivotally attach the respective peg bar to the respective base plate;

wherein the peg bar of each base plate extends transversely across the respective base plate front face thereby interconnecting the brackets on the respective base plate; and wherein each peg bar is pivotal between a use position and a stowed position.

4. The Team Dugout Organizer of claim 1, wherein each angle stop is attached to the respective base plate front face.

5. A portable Team Dugout Organizer for organizing individual player's equipment, comprising:

two base plates foldably attached together, each base plate comprising a front face, a rear face, a bottom section, and a top section comprising a handle opening;

a peg bar pivotally attached to each respective base plate front face, each peg bar comprising a plurality of pegs which extend in a direction generally upwardly toward the respective base plate top section; and an angle stop disposed to limit rotation of each respective peg bar so that a maximum angle of rotation of the respective pegs away from a plane of the respective base plate is less than ninety degrees;

wherein each base plate bottom section comprises a plurality of helmet strap openings, and further comprising an adjustable helmet strap comprising a clip extending through each of the helmet strap openings.

6. The Team Dugout Organizer of claim 1, further comprising:

each base plate handle opening is off-set from a horizontal midpoint of the respective base plate front face, and wherein each base plate handle opening is positioned such that when the rear faces of the two base plates are brought together, the base plate handle openings are in alignment; and the off-set handle openings are positioned so that the base plates balance at an angle to horizontal when being carried by a user's hand in the handle openings, and the handle openings are shaped such that a top surface of each opening that is supported by the user's hand is substantially parallel to the ground when the Team Dugout Organizer is being carried.

7. A portable Team Dugout Organizer for organizing individual player's equipment, comprising:

two base plates foldably attached together, each base plate comprising a front face, a rear face, a bottom section, and a top section comprising a handle opening;

a peg bar pivotally attached to each respective base plate front face, each peg bar comprising a plurality of pegs which extend in a direction generally upwardly toward the respective base plate top section; and an angle stop disposed to limit rotation of each respective peg bar so that a maximum angle of rotation of the respective pegs away from a plane of the respective base plate is less than ninety degrees;

wherein each angle stop extends from the respective peg bar in a direction of the respective base plate bottom section and thereby limits rotation of the respective peg bar from a stowed position wherein the pegs are proximate the base plate top section to a use position wherein the pegs extend from the peg bar at an angle of less than 70 degrees from a plane of the respective base plate.

8. A portable Team Dugout Organizer for organizing individual player's equipment, comprising:

a base plate;

a peg bar pivotally attached to a front face of the base plate;

a plurality of glove pegs extending from the peg bar, wherein rotation of the peg bar causes angular movement of the glove pegs relative to a plane of the base plate between a use position angle and a stowed position angle; and an angle stop limiting rotation of the peg bar such that the use position angle is less than ninety degrees relative to the plane of the base plate to facilitate gravity holding a player's glove on a respective glove peg;

further comprising a plurality of helmet strap openings formed in the base plane and an adjustable helmet strap extending through each of the helmet strap openings.

9. The Team Dugout Organizer of claim 8 wherein position marking or indicia is associated with each glove peg directly corresponding with a sequence of the field positions on a playing field so that players can efficiently remove or place their respective playing equipment on the Team Dugout Organizer in an orderly manner as they enter and exit a dugout.

10. The Team Dugout Organizer of claim 8, further comprising a handle formed in the base plate off-set from a horizontal midpoint of the base plate so that the base plate will balance at an angle relative to a horizontal line when held by the handle.

11. The Team Dugout Organizer of claim 8, further comprising brackets mounted at opposed ends of the base plate front face and pivotally attached to the peg bar.

12. The Team Dugout Organizer of claim 8, wherein the angle stop limits rotation of the peg bar such that the use position angle is in a range of 40-60 degrees relative to the plane of the base plate.

13. The Team Dugout Organizer of claim 8, wherein the angle stop is attached to the peg bar.

14. The Team Dugout Organizer of claim 8, further comprising a plurality of hat hooks attached to the base plate front face, the hat hooks being positioned below the peg bar and aligned with respective glove pegs.

15. A portable Team Dugout Organizer for organizing individual player's equipment in a dugout, comprising:

two base plates foldably attached together, each base plate comprising a front face, a rear face, and a top section comprising a handle opening;

wherein each base plate bottom section comprises a plurality of helmet strap openings with an adjustable helmet strap extending through each of the helmet strap openings;

wherein each base plate handle opening is aligned off-set from a midpoint of the respective base plate front face;

wherein each base plate handle opening is positioned such that when the rear faces of the two base plates are brought together, the base plate handle openings are in alignment;

brackets mounted proximate opposed ends of each base plate front face, wherein the brackets support a pivotally attached peg bar extending transversely across each respective base plate front face;

a plurality of glove pegs extending from each peg bar;

an angle stop abutting each respective peg bar to limit peg bar rotation;

wherein each peg bar is pivotable at the brackets between a stowed position where the glove pegs are closest to the respective base plate top section and a use position where the glove pegs are rotated away from the respective base plate top section.

16. The Team Dugout Organizer of claim 15, wherein position marking or indicia is associated with each glove peg to designate respective field positions directly corresponding with a sequence and orientation of positions on a playing field so that players can efficiently remove or place playing equipment on the Team Dugout Organizer in an orderly manner as they enter and exit the dugout.

17. The Team Dugout Organizer of claim 15, further comprising hat hooks mounted on each base plate front face, the hat hooks being positioned below the respective peg bar and aligned with the respective glove pegs.

18. The Team Dugout Organizer of claim 15, wherein the angle stop is positioned to limit peg bar rotation so that in the use position the respective glove pegs are disposed at an angle of less than 70 degrees relative to a plane of the respective base plate.

* * * * *